US010109137B2

(12) United States Patent
Park et al.

(10) Patent No.: US 10,109,137 B2
(45) Date of Patent: Oct. 23, 2018

(54) BANKNOTE STACKING APPARATUS

(71) Applicant: NAUTILUS HYOSUNG INC., Seoul (KR)

(72) Inventors: Jong Seong Park, Anyang-si (KR); Seok Won Kim, Gwangmyeong-si (KR); Jun Young Kim, Gyeonggi-do (KR); Sung Jin Moon, Suwon-si (KR); Chang Ho Park, Gunpo-si (KR); Young Chul Lee, Yongin-si (KR); Soon Ho Choi, Suwon-si (KR)

(73) Assignee: HYOSUNG TNS INC., Seoul (KR)

( * ) Notice: Subject to any disclaimer, the term of this patent is extended or adjusted under 35 U.S.C. 154(b) by 0 days.

(21) Appl. No.: 15/702,622

(22) Filed: Sep. 12, 2017

(65) Prior Publication Data

US 2018/0082507 A1 Mar. 22, 2018

(30) Foreign Application Priority Data

Sep. 22, 2016 (KR) ..... 10-2016-0121568

(51) Int. Cl.
*B65H 31/06* (2006.01)
*B65H 31/26* (2006.01)
(Continued)

(52) U.S. Cl.
CPC ..... *G07D 11/0027* (2013.01); *B65H 29/52* (2013.01); *B65H 31/06* (2013.01);
(Continued)

(58) Field of Classification Search
CPC ..... B65H 31/06; B65H 31/26; B65H 29/22; B65H 29/40
See application file for complete search history.

(56) References Cited

U.S. PATENT DOCUMENTS 8,096,548 B2 * 1/2012 Iwami ..... B65H 3/0638 271/119
8,419,005 B2 * 4/2013 Nomiyama ..... B65H 1/025 271/177

(Continued)

FOREIGN PATENT DOCUMENTS

EP 1326215 A2 7/2003
JP 2015014969 A * 1/2015 ..... G07D 11/0018
KR 10-2013-0116640 A 10/2013

OTHER PUBLICATIONS

European Extended Search Report, European Application No. 17188497.6, dated Feb. 6, 2018, 7 pages.

*Primary Examiner* — Luis A Gonzalez
(74) *Attorney, Agent, or Firm* — Fenwick & West LLP

(57) ABSTRACT

The present invention is directed to providing a banknote stacking apparatus capable of stably stacking banknotes even when various types of banknotes are stacked therein by preventing banknotes stacked in the banknote stacking space from being blown away. The banknote stacking apparatus includes a stacker for stacking banknotes in the banknote stacking space; a push plate for supporting the banknotes stacked in the banknote stacking space and be movable in a reciprocating direction; a stack guide configured to guide the banknote which passes the stacker to be loaded into the banknote stacking space; a damper configured to press the banknote introduced into one side of the banknote stacking space toward the push plate located on the other side of the banknote stacking space; and a damper driver operating the damper to move in a direction toward the banknote stacking space and a direction away from the banknote stacking space.

14 Claims, 13 Drawing Sheets

(51) Int. Cl.
*G07D 11/00* (2006.01)
*B65H 29/52* (2006.01)

(52) U.S. Cl.
CPC ..... *B65H 31/26* (2013.01); *G07D 11/0036* (2013.01); *B65H 2404/1114* (2013.01); *B65H 2404/63* (2013.01); *B65H 2404/693* (2013.01); *B65H 2701/1912* (2013.01)

(56) References Cited

U.S. PATENT DOCUMENTS

| | | | | |
|---|---|---|---|---|
| 9,633,501 | B2 * | 4/2017 | Mitsuyama ..... | G07D 11/0027 |
| 9,845,217 | B2 * | 12/2017 | Shin ..... | B65H 5/06 |
| 2011/0031308 | A1 | 2/2011 | Holland-Letz et al. | |

* cited by examiner

BANKNOTE STACKING APPARATUS

CROSS-REFERENCE TO RELATED APPLICATION

This application claims priority under 35 U.S.C § 119(a) to Republic of Korea patent application No. 10-2016-0121568 filed on Sep. 22, 2016, which is incorporated by reference herein in its entirety.

BACKGROUND

1. Field of the Invention

The present invention relates to a banknote stacking apparatus, and more specifically, to a banknote stacking apparatus which prevents stacked banknotes from being blown away and is capable of stably stacking banknotes by temporarily holding banknotes which enter a banknote stacking space for a predetermined time.

2. Discussion of Related Art

Generally, a banknote stacking apparatus is an apparatus installed in an automatic teller machine and stacks banknotes, checks, and other stackable objects having a predetermined thickness (hereinafter, referred to as "banknotes") in a banknote stacking space. The banknote stacking apparatus is used in a deposit and withdrawal part, a temporary storage, a banknote storage, and the like of the automatic teller machine.

Referring to FIG. 1, in one lower side of a conventional banknote stacking apparatus 1, a pair of transfer rollers 21 and 22, which are installed at both sides of the return path 10 to face each other, and a stacker 20, which includes a stack roller 23 to which a plurality of elastic sheets 23*a* are attached to stack banknotes by hitting a rear end of a banknote P sandwiched between the pair of transfer roller 21 and 22 and introduced into one side of the banknote stacking space 30, are installed as a configuration for stacking banknotes P returned along a return path 10 in a banknote stacking space 30.

A push plate 40 for supporting stacked banknotes P is provided in the banknote stacking space 30, and a stack guide 50 for preventing the banknotes P which enter the banknote stacking space 30 from being blown away is provided on one side of the banknote stacking space 30.

When the banknote P returned along the return path 10 passes the pair of transfer rollers 21 and 22 and enter the one side of the banknote stacking space 30, the rear end of the banknote P introduced into the one side of the banknote stacking space 30 is hit by the rotating elastic sheet 23*a* of the stack roller 23 and stacked in a direction toward the push plate 40.

In this case, as illustrated in FIG. 1, since a tangential direction T in which the elastic sheet 23*a* hits the rear end of the banknote P is a direction upwardly inclined at a predetermined angle θ with respect to a lateral surface H, the banknote P hit by the elastic sheet 23*a* is seated and stacked on a floor surface of the banknote stacking space 30 after being hit in the upwardly inclined direction toward the push plate 40 and being blown toward a location separated upward from the floor surface of the banknote stacking space 30, it is difficult for the banknotes P to be neatly stacked in an aligned state because the banknotes P may be deformed due to an impact generated when the banknote P is seated.

As one example of a prior art related to such a banknote stacking apparatus, in Korean Laid-open Patent No. 10-2012-0078338, a banknote stacking apparatus which controls a rotation of a seat roller (stack roller) to be stopped while a banknote passes and rotated so that elastic sheet hits a rear end of the banknote when the banknote passed such that the banknote is located in a banknote stacking space is disclosed.

However, according to a configuration of Korean Laid-open Patent No. 10-2012-0078338, a speed at which the banknote enters the banknote stacking space may be reduced, but since the elastic sheet hits the banknote in inclined direction, the above described problems occur.

Meanwhile, although one of conventional banknote stacking apparatuses provides a stopper at an upper portion of a banknote stacking space and formed to prevent a banknote from being blown away when the banknote is stacked in the banknote stacking space using a rotary stack roller having elastic sheets attached to the entirety of an outer circumferential surface thereof at a predetermined interval, the banknote cannot be effectively prevented from being blown away by only a configuration of the stopper when small banknotes are stacked in a large banknote stacking space configured to stack various types of banknotes therein.

Referring to FIG. 1, according to an increase of the number of the banknotes P stacked in the banknote stacking space 30, the push plate 40 is formed to move to one side (to a left side of the drawing) in proportion to the number of the stacked banknotes P in the conventional banknote stacking apparatus 1 to provide a free space so that a banknote subsequently entering into the banknote stacking space 30 can be stacked therein.

However, the banknotes stacked in the banknote stacking space 30 may include not only neatly stacked banknotes but abnormal banknotes such as stacked being folded to one side or skewed banknotes stacked in an inclined state, however, the free space, in which the banknote subsequently entering into the banknote stacking space 30 can be stacked, cannot be sufficiently secured due to such abnormal banknotes such that the banknotes cannot be smoothly stacked when the push plate 40 is conventionally formed to be moved by a predetermined distance in proportion to the number of the stacked banknotes P.

SUMMARY OF THE INVENTION

The present invention is directed to a banknote stacking apparatus capable of stably stacking banknotes even when various types of banknotes are stacked therein by preventing banknotes stacked in a banknote stacking space from being blown away.

The present invention is also directed to a banknote stacking apparatus capable of properly controlling a moving distance of a push plate according to an increase in the number of banknotes stacked in a banknote stacking space in response to a state inside the banknote stacking space.

According to an aspect of the present invention, there is provided a banknote stacking apparatus including: a stacker for stacking banknotes in the banknote stacking space; a push plate provided to support the banknotes stacked in the banknote stacking space and be movable in a reciprocating direction; a stack guide configured to guide the banknote which passes the stacker to be loaded into the banknote stacking space; a damper configured to press the banknote introduced into one side of the banknote stacking space toward the push plate located on the other side of the banknote stacking space and prevent the banknote from being blown away; and a damper driver configured to operate the damper to move in a direction toward the banknote stacking space and a direction away from the banknote stacking space.

The damper may be provided to be coupled to an upper portion of the stack guide and is rotatable in the direction toward the banknote stacking space and the direction away from the banknote stacking space based on a front surface of the stack guide.

The damper may leave the banknote stacking space and is located inside the stack guide before the banknote enters the banknote stacking space; and the damper is rotated toward a front side of the stack guide and presses the banknotes toward the push plate at a time at which the banknote enters the banknote stacking space.

The damper may include: a rotary shaft part rotatably coupled to the stack guide; and a plurality of pressers configured to overlap the stack guide and be rotated in the direction toward the banknote stacking space and the direction away from the banknote stacking space based on the front surface of the stack guide, and provided at a predetermined interval.

The banknote stacking apparatus may further comprising: a damper sensor configured to sense a location of a protruding piece rotated, wherein the protruding piece is formed to protrude outward from the rotary shaft part of the damper; and a controller configured to control an operation of the damper driver on the basis of a signal sensed in the damper sensor.

The banknote stacking apparatus may further comprising: a banknote sensor configured to sense whether the banknote transferred into the banknote stacking space pass by; and a controller configured to control an operation of the damper driver on the basis of a time at which the banknote sensed by the banknote sensor passes the banknote sensor.

The controller may control the operation of the damper driver on the basis of a time at which a rear end of the banknote sensed by the banknote sensor passes the banknote sensor.

The controller may control the damper to be rotated toward a front side of the stack guide, press a preceding banknote toward the push plate, and hold the preceding banknote when a predetermined time elapses after a rear end of the preceding banknote is sensed by the banknote sensor, and controls the damper to be rotated in the direction away from the banknote stacking space and release the preceding banknote when the banknote sensor senses a front end of a next banknote.

The predetermined time may have a fixed value and is a time from a time at which the rear end of the preceding banknote is sensed by the banknote sensor to a time at which the rear end of the preceding banknote enters the banknote stacking space.

The stacker may include a stack roller having a plurality of elastic sheets which hit a banknote pressed by the damper and are attached to an outer circumferential surface thereof.

The stack roller may hit a banknote moved by the damper in a lateral direction toward the push plate.

The damper driver may include: a motor configured to be bidirectionally and rotatably operated; and a belt configured to transfer power of the motor to the rotary shaft part of the damper.

The banknote stacking apparatus may further comprising: a stack guide sensor configured to sense a location of the stack guide rotated and provided to be rotatable in a range of a predetermined angle according to an increase of the number of banknotes stacked in the banknote stacking space; a push plate driver configured to operate the push plate to move in a reciprocating direction; and a controller configured to control an operation of the push plate driver on the basis of a signal sensed by the stack guide sensor.

The banknote stacking apparatus may further comprising: a stacked banknote sensor configured to sense a presence or absence of banknotes stacked in the banknote stacking space, wherein the controller controls the operation of the push plate driver on the basis of a signal sensed by the stacked banknote sensor.

The stacked banknote sensor may include a first stacked banknote sensor and a second stacked banknote sensor separated at both sides of the banknote stacking space.

The controller may control the operation of the push plate driver so that the push plate is moved to a set location to expand the banknote stacking space when the stack guide sensor senses that the stack guide is located at a location at which the stack guide is pushed backward and rotated due to the number of banknotes stacked in the banknote stacking space, and the first stacked banknote sensor and the second stacked banknote sensor simultaneously sense the presence of banknotes.

The controller may control the operation of the push plate driver in a step-by-step manner so that the push plate is moved until the stack guide is not sensed by the stack guide sensor.

A protrusion may be formed on one side of the stack guide; and the stack guide sensor senses a location of the protrusion rotated.

The stack guide may be elastically supported to be rotated in the direction toward the banknote stacking space.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
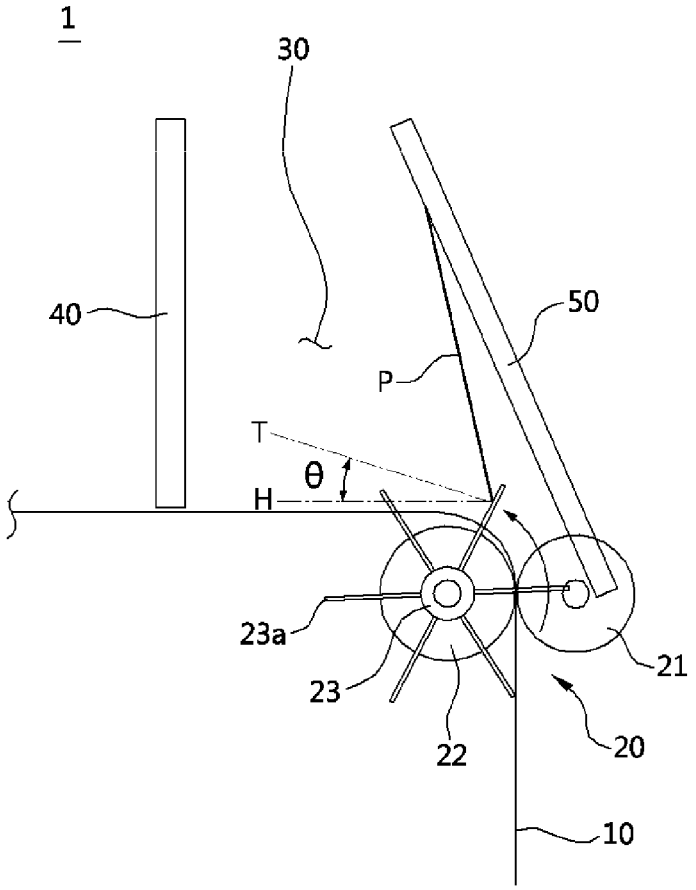
PRIOR ART FIG. 1
FIG. 1 is a view for describing a problem of a banknote stacking apparatus according to a conventional art.
Figure 2:
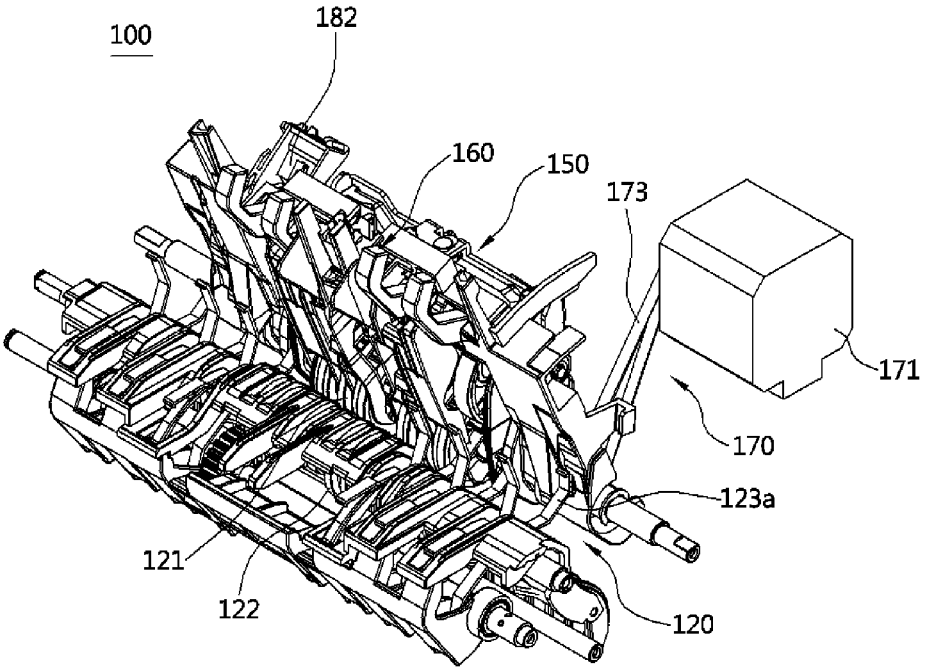
FIGS. 2 and 3 are perspective views of a banknote stacking apparatus according to a first embodiment of the present invention when viewed in different directions.

Hereinafter, configurations and operations of a preferable embodiment of the present invention will be described in detail with reference to the accompanying drawings.

Referring to FIGS. 2 to 6, a banknote stacking apparatus 100 according to a first embodiment of the present invention includes a stacker 120 for stacking banknotes moved along a return path 110 in a banknote stacking space 130, a push plate 140 provided to support the banknotes stacked in the banknote stacking space 130 and capable of reciprocating, a stack guide 150 configured to guide the banknote which passes the stacker 120 to be loaded into the banknote stacking space 130, a damper 160 configured to press the banknote introduced into one side of the banknote stacking space 130 in a direction toward the other side of the banknote stacking space 130 and prevent the banknote from being blown away, and a damper driver 170 configured to operate the damper 160 to be rotated in a direction toward the banknote stacking space 130 and a direction away from the banknote stacking space 130.

Further, the banknote stacking apparatus 100 further includes a banknote sensor 181 for sensing whether banknotes transferred toward the stacker 120 along the return path 110 pass by, a damper sensor 182 for sensing a location of the damper 160 rotated, and a controller 190 configured to control operations of the stacker 120 and the damper driver 170 on the basis of signals sensed by the banknote sensor 181 and the damper sensor 182.

As a configuration for stacking the banknotes returned along the return path 110 and introduced into one side of the banknote stacking space 130 in the banknote stacking space 130, the stacker 120 includes a first transfer roller 121 and a second transfer roller 122 provided on sides which face each other with the return path 110 disposed therebetween and configured to transfer the banknote through therebetween, and a stack roller 123 coupled to the same shaft as the second transfer roller 122 and having a plurality of elastic sheets 123*a* which are attached to an outer circumferential surface thereof, and hit a rear end of the banknote introduced into the banknote stacking space 130.

The push plate 140 is provided to be laterally moved according to an increase or a decrease of the number of banknotes stacked in the banknote stacking space 130. That is, the push plate 140 is located at one side of the banknote stacking space 130 (a right side in FIG. 4) when the number of banknotes stacked in banknote stacking space 130 is small, and is moved toward the other side of the banknote stacking space 130 (a left side in FIG. 4) so that a space into which banknotes may be loaded is secured according to the increase of the number of banknotes stacked in the banknote stacking space 130.

The stack guide 150 prevents the banknote quickly introduced toward the banknote stacking space 130 by the first transfer roller 121 and the second transfer roller 122 from being blown away in an upward direction and guides the banknote to be moved toward the push plate 140 in the banknote stacking space 130. The stack guide 150 is disposed to have an upward inclination from a lower end located on a lower portion of one side of the banknote stacking space 130 to an upper end located on an upper portion of the one side of the banknote stacking space 130. Accordingly, a front end of the banknote which passes the first transfer roller 121 and the second transfer roller 122 may be guided in the direction toward the push plate 140 via a front surface 151 of the stack guide 150.

When the banknote enters the banknote stacking space 130, the damper 160 prevents the banknote from being blown away by pressing the banknote toward the push plate 140 located on the other side of the banknote stacking space 130 and temporarily holding the banknote.

Figure 5:
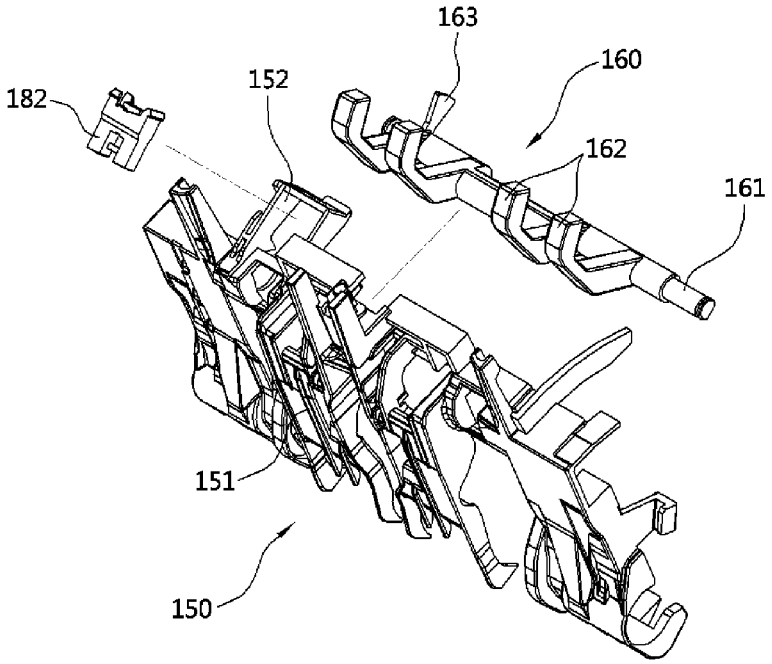
FIG. 5 is an exploded perspective view illustrating a stack guide, a damper, and a damper sensor provided in the banknote stacking apparatus according to the first embodiment of the present invention.
Figure 6:
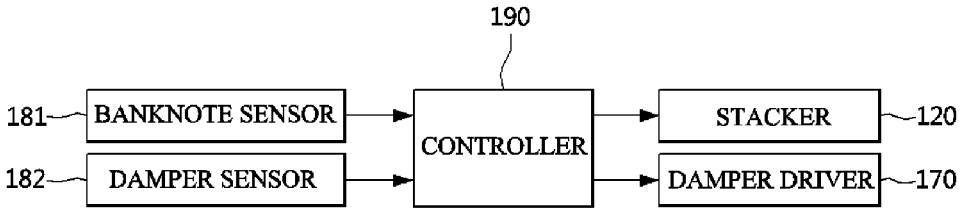
FIG. 6 is a control block diagram of the banknote stacking apparatus according to the first embodiment of the present invention.

Referring to FIG. 5, the damper 160 includes a rotary shaft part 161 rotatably coupled to the stack guide 150, a plurality of pressers 162 configured to overlap the stack guide 150, be rotated in the direction toward the banknote stacking space 130 and the direction away from the banknote stacking space 130 on the basis of the front surface 151 of the stack guide 150, and provided at a predetermined interval.

Here, the meaning of overlapping the stack guide 150 and the damper 160 is that the presser 162 of the damper 160 is provided to be rotatable in frontward and rearward directions on a portion, which is formed to open in in frontward and rearward directions, of an upper portion of the stack guide 150.

Further, a protruding piece 163 having a fan shape is formed to protrude outward from the rotary shaft part 161 of the damper.

Also, the damper sensor 182 for sensing a location of the protruding piece 163 of the damper 160 is provided and coupled to a mounting part 152 formed on one side of the upper portion of the stack guide 150. The controller 190 may accurately control the location of the damper 160 rotated by controlling operation of the damper driver 170 on the basis of the signal sensed by the damper sensor 182.

Figure 3:
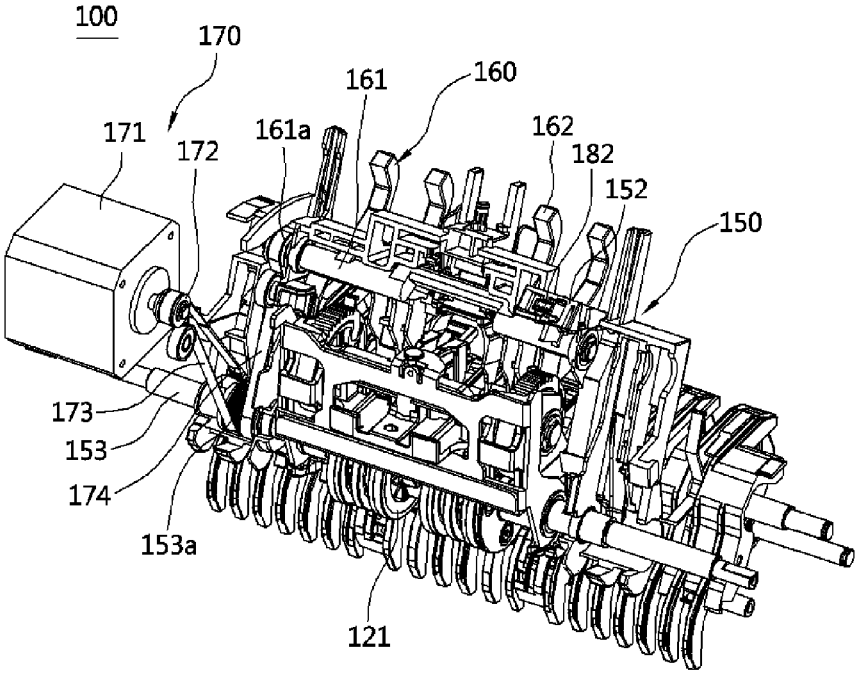
Figure 4:
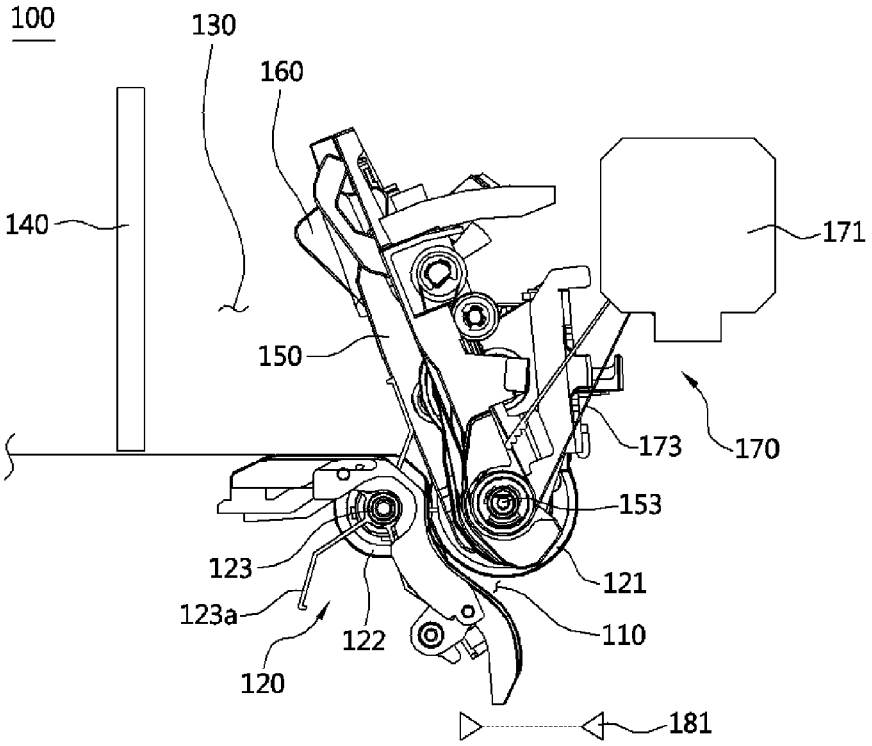
FIG. 4 is a side view of the banknote stacking apparatus according to the first embodiment of the present invention.

Referring to FIG. 3, the damper driver 170 serves to operate the presser 162 of the damper 160 to be rotatably moved in the direction toward the banknote stacking space 130 (a left side direction in the drawing) and moved toward a rear side of the stack guide 150 (a right side direction in the drawing) by being moved in a direction away from the banknote stacking space 130.

In one embodiment, the damper driver 170 may include a motor 171 configured to be bidirectionally and rotatably operated and belts 173 and 174 configured to transmit power of the motor 171 to the rotary shaft part 161 of the damper 160. In this case, the belts 173 and 174 may include the first belt 173, which connects a pinion 172 coupled to a rotary shaft of the motor 171 and one side of a pulley 153*a* formed on a rotary shaft 153 to transmit power therebetween, and the second belt 174, which connects the other side of the pulley 153*a* and a pulley 161*a* coupled to the rotary shaft part 161 of the damper 160 to transmit power therebetween.

However, the damper driver 170 may be formed in various forms as long as the damper 160 is capable of bidirectionally rotating. For example, the damper driver may include a cam (not shown) in contact with a rear surface of the damper 160, a motor configured to rotatably operate the cam, and an elastic member configured to elastically support the damper 160 to be in contact with the cam.

Meanwhile, the banknote sensor 181 has a configuration for sensing whether a banknote transferred toward the banknote stacking space 130 along the return path 110 passes by, the banknote sensor 181 may include an optical sensor including a light emitter and a light receiver, and various sensing methods may be applied thereto to sense whether a banknote passes by.

The controller 190 controls the operation of the damper driver 170 on the basis of a time at which a rear end of a banknote sensed by the banknote sensor 181 passes the banknote sensor, a transfer speed of the banknote in the return path 110, a distance between the banknote sensor 181 and a banknote inlet of the banknote stacking space 130, and the like. Here, on the basis of the time at which the rear end of the banknote sensed by the banknote sensor 181 passes the banknote sensor 181, the controller 190 may control a hitting time of the rear end of the banknote and a hitting point of the rear end of the banknote using the stack roller 123 to be uniform by operating the stacker 120 and the damper driver 170, and may accurately control the location of the damper 160 rotated on the basis of the time at which the rear end of the banknote sensed by the banknote sensor 181 passes the banknote sensor 181 regardless of a difference of lengths of banknotes according to types of banknotes passing the banknote sensor 181.

According to one embodiment, the controller 190 controls the damper 160 to be rotated toward a front side of the stack guide 150, press a preceding banknote toward the push plate 140, and hold the preceding banknote when a predetermined time elapses after a rear end of the preceding banknote is sensed by the banknote sensor 181, and controls the damper 160 to be rotated in the direction away from the banknote stacking space 130 to release the preceding banknote when a front end of the next banknote is sensed by the banknote sensor 181.

The predetermined time has a fixed value and may be set to a time from a time at which the rear end of the preceding banknote is sensed by the banknote sensor 181 to a time at which the rear end of the preceding banknote enters the banknote stacking space 130.

Figure 7:
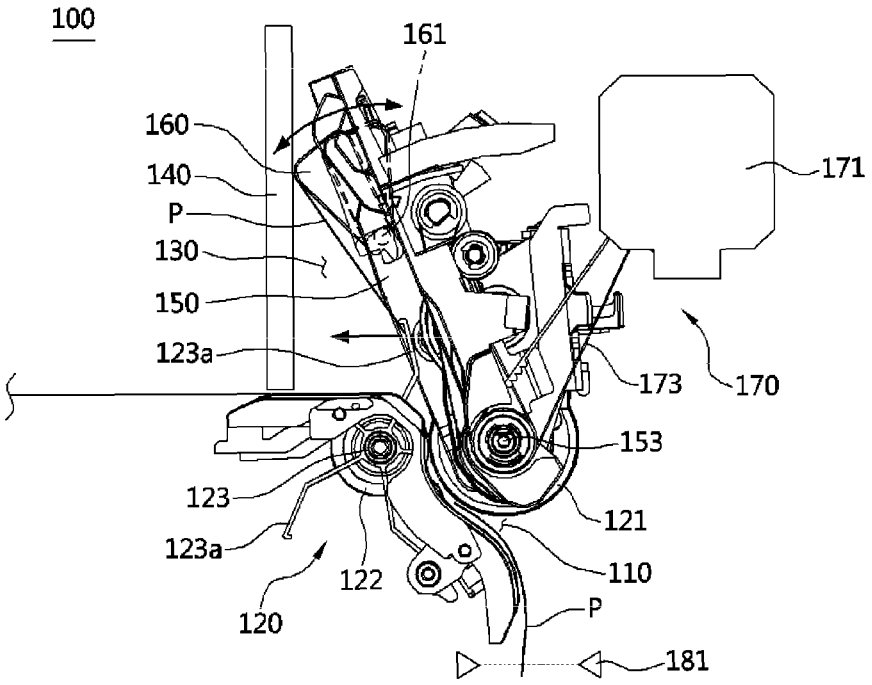
FIG. 7 is a view illustrating an initial state of banknotes stacked in a banknote stacking space of the banknote stacking apparatus according to the first embodiment of the present invention.
Figure 8:
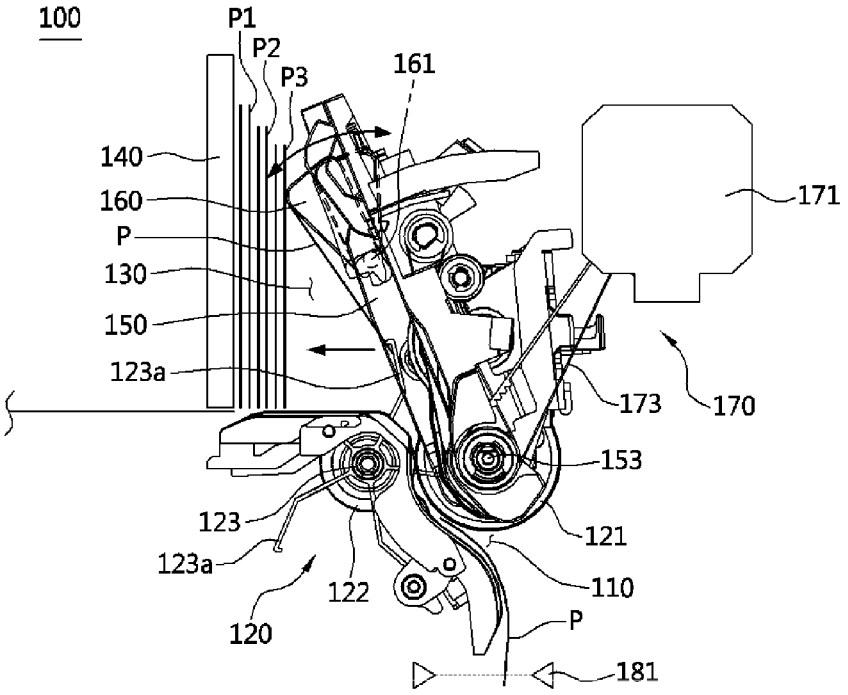
FIG. 8 is a view illustrating a state of various types of banknotes stacked in the banknote stacking space of the banknote stacking apparatus according to the first embodiment of the present invention.
Figure 9:
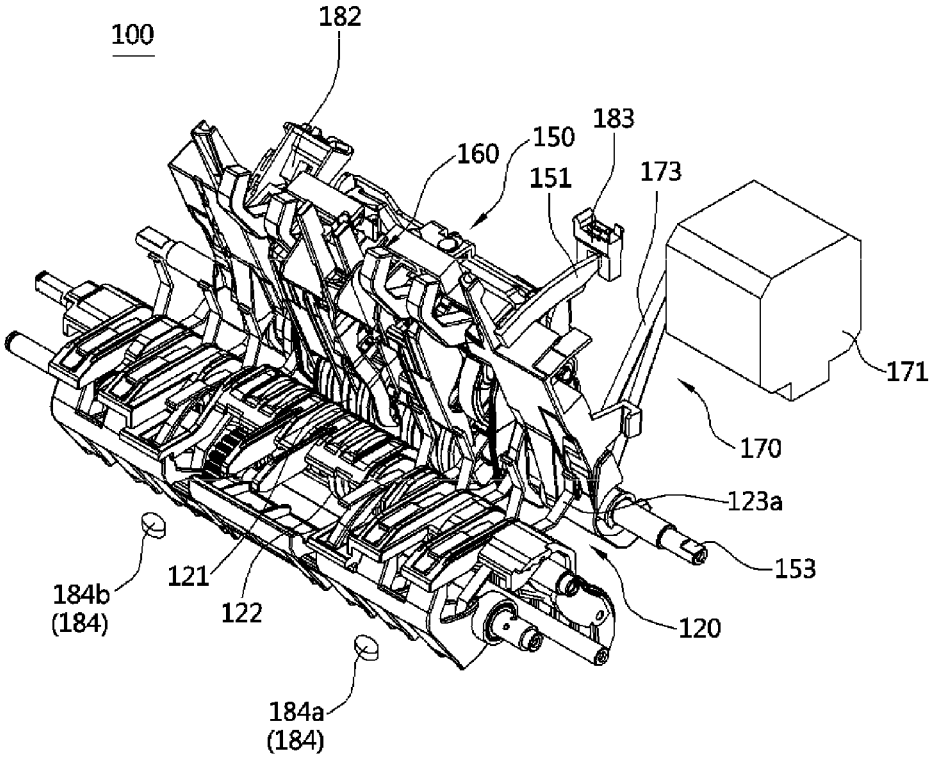
FIG. 9 is a perspective view of a banknote stacking apparatus according to a second embodiment of the present invention.
Figure 10:
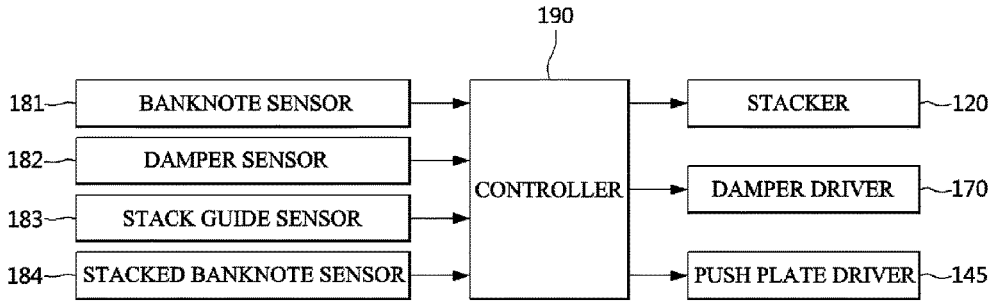
FIG. 10 is a control block diagram of the banknote stacking apparatus according to the second embodiment of the present invention.

Referring to FIGS. 7 and 8, the damper 160 leaves the banknote stacking space 130 and is located inside the stack guide 150 before a banknote P enters the banknote stacking space 130, as shown by a dotted line in the drawing, and the damper 160 is rotated toward the front side of the stack guide 150 and presses the banknote P toward the push plate 140 at a time at which the banknote enters the banknote stacking space 130 as shown by a solid line in the drawing. In this case, an upper end of the banknote P is pressed between the push plate 140 and the damper 160 (see FIG. 7) or pressed between banknotes already stacked on the push plate 140 and the damper 160 (see FIG. 8), and is temporarily stopped. At the same time, the banknote P hit by the elastic sheets 123*a* of the stack roller 123 is laterally moved toward the push plate 140, as shown by an arrow, and may be stably stacked in the banknote stacking space 130. Accordingly, even when various types of banknotes P, P1, P2 and P3 having different lengths are stacked, the banknotes can be effectively prevented from being blown away, and stacking quality of the banknotes can be improved.

Hereinafter, configurations and operations of a banknote stacking apparatus according to a second embodiment will be described with reference to FIGS. 9 to 13, however, detailed descriptions of configurations which overlap the above-described embodiment will be omitted, and the second embodiment will be described on the basis of detailed descriptions of configurations different from those in the above-described embodiment.

A banknote stacking apparatus 100 according to the second embodiment includes all the above described components of the first embodiment of the present invention and includes a stack guide sensor 183, stacked banknote sensors 184 or 184*a* and 184*b*, and a push plate driver 145 to properly control a moving distance of a push plate 140 according to the number of banknotes P stacked in a banknote stacking space 130.

The push plate driver 145 is configured to provide power for reciprocating to the push plate 140 and may include a power transmission unit such as a driving motor (not shown), a belt (not shown) coupled to the push plate 140 and configured to transmit power of the driving motor to the push plate 140, etc.

According to the embodiment, as the number of banknotes P stacked in the banknote stacking space 130 increases, the stack guide 150 is provided to be rotatable in a range of a predetermined angle on the basis of a rotary shaft 153 and is elastically supported in the direction toward banknote stacking space 130 by an elastic member (not shown).

The stack guide sensor 183 is configured to sense a location of the stack guide 150 rotated. A protrusion 151 having a length extending to a predetermined length in a direction opposite to the direction toward the banknote stacking space 130 is formed on one side of the stack guide 150, and the stack guide sensor 183 may sense the location of the stack guide 150 rotated by sensing whether the protrusion 151 passes by. The stack guide sensor 183 includes a light emitter and a light receiver at separate locations toward both sides thereof, and a space through which the protrusion 151 may pass is formed between the light emitter and the light receiver.

Figure 11:
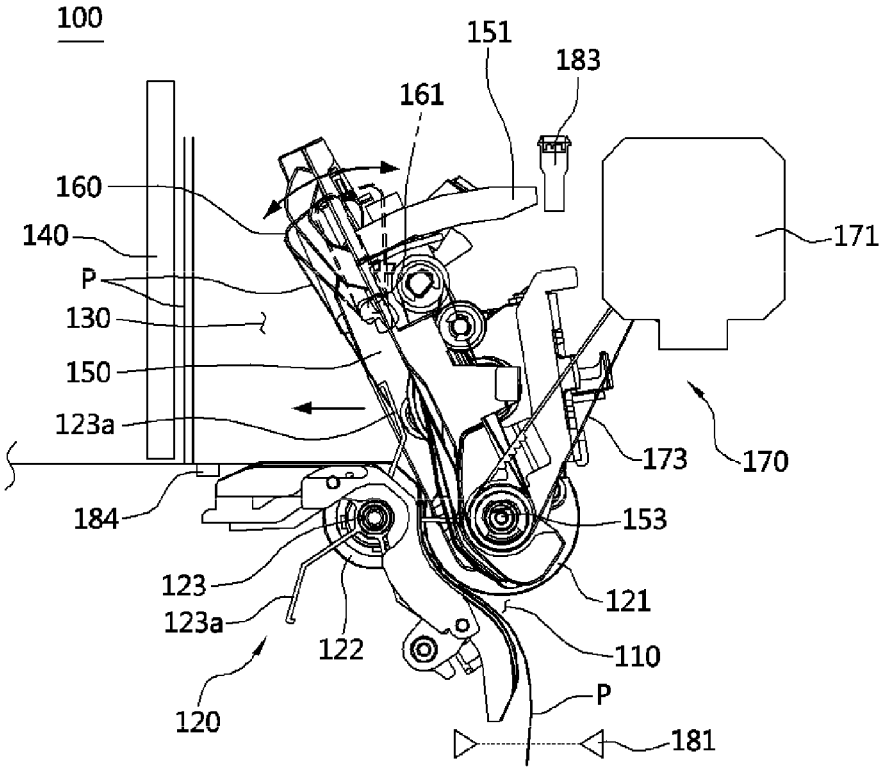
FIG. 11 is a view illustrating an initial state of banknotes stacked in a banknote stacking space of the banknote stacking apparatus according to the second embodiment of the present invention.

As illustrated in FIG. 11, when the number of banknotes P stacked in the banknote stacking space 130 is small, the stack guide 150 is rotated in a counterclockwise direction, based on a direction of the drawing, by an elastic force of the elastic member, and in this case, since the protrusion 151 is located on an outer side of the stack guide sensor 183, the stack guide sensor 183 senses a light signal.

Figure 12:
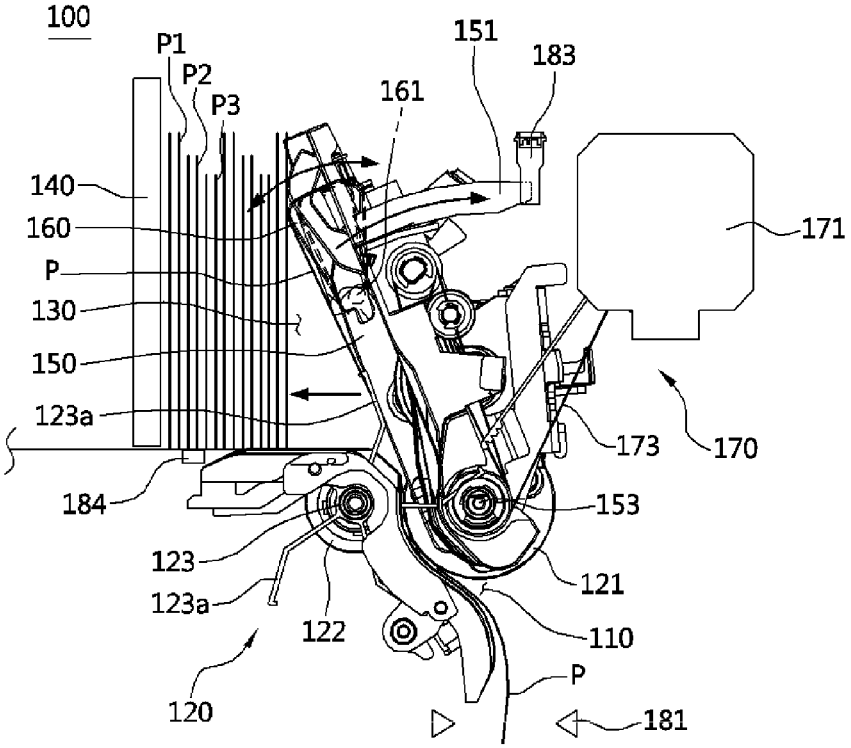
FIG. 12 is a view illustrating a state of a stack guide rotated in a direction opposite to a direction toward the banknote stacking space according to an increase of the number of banknotes stacked in the banknote stacking space of the banknote stacking apparatus according to the second embodiment of the present invention.

As illustrated in FIG. 12, the damper 160 is pressed by the stacked banknotes and rotated in the direction opposite to the direction toward the banknote stacking space 130 when the number of banknotes P stacked in banknote stacking space 130 increases, and the stack guide 150 is pushed and rotated in a clockwise direction, based on the direction of the drawing, when the pressed damper 160 is pressed past a range in which the pressed damper 160 is rotatable, and, at this time, the protrusion 151 moves into the stack guide sensor 183 and the stack guide sensor 183 senses a dark signal.

The controller 190 controls an operation of the push plate driver 145 on the basis of the signal sensed by the stack guide sensor 183.

Meanwhile, the stacked banknote sensors 184 or 184*a* and 184*b* are configured to sense the presence or absence of banknotes stacked in the banknote stacking space 130 and may include the first stacked banknote sensor 184*a* and the second stacked banknote sensor 184*b* separated at both sides of the banknote stacking space 130.

The stacked banknote sensors 184 or 184*a* and 184*b* may be provided on a lower portion of one side of the banknote stacking space 130 and may include a light emitter and a light receiver.

Figure 13:
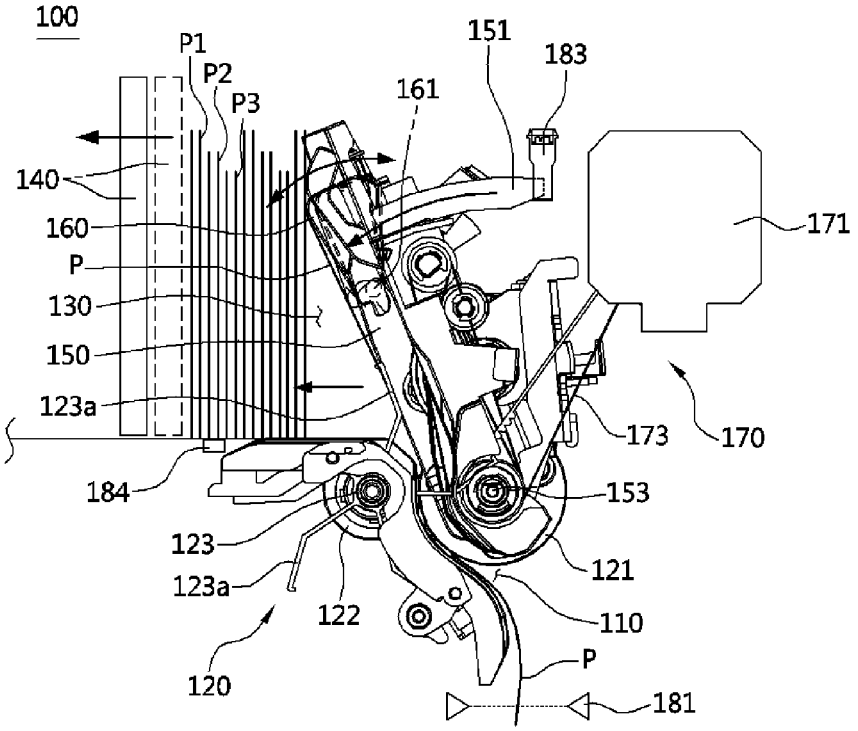
FIG. 13 is a view illustrating a state of a push plate being moved from the state of FIG. 12.

Accordingly, since the number of banknotes stacked in banknote stacking space 130 is small at an initial stage of stacking the banknotes, the stacked banknote sensors 184 or 184*a* and 184*b* sense the light signal as illustrated in FIG. 11, and the stacked banknote sensors 184 or 184*a* and 184*b* sense the dark signal when the number of banknotes stacked in banknote stacking space 130 is increased as illustrated in FIGS. 12 and 13.

Further, one sensor among the first stacked banknote sensor 184*a* and the second stacked banknote sensor 184*b* may sense the light signal when the banknotes stacked in the banknote stacking space 130 are folded to one side or skewed banknotes stacked in an inclined state. The signal sensed by the stacked banknote sensors 184 or 184*a* and 184*b* may be transmitted to the controller 190, and the controller 190 controls the operation of the push plate driver 145 on the basis of the signal sensed by the stacked banknote sensors 184 or 184*a* and 184*b*.

Hereinafter, an operation of the controller 190 for controlling an operation of the push plate driver 145 will be described on the basis of signals sensed by the stack guide sensor 183 and the stacked banknote sensors 184 or 184*a* and 184*b*.

First, all of the stack guide sensor 183 and the stacked banknote sensors 184 or 184*a* and 184*b* sense the light signal at an initial stage of stacking banknotes, as illustrated in FIG. 11, and, in this case, the controller 190 controls the push plate driver 145 so that the push plate 140 is kept in a stopped state.

Also, the controller 190 controls the push plate driver 145 so that the push plate 140 is kept in the stopped state even when the light signal is sensed by only one sensor among the stack guide sensor 183 and the stacked banknote sensors 184 or 184*a* and 184*b*.

That is, the controller 190 determines that the banknote stacking space 130 has free space in which banknotes may be stacked and controls the push plate driver 145 so that the push plate 140 is kept in the stopped state when the dark signal is sensed by the stacked banknote sensors 184 or 184*a* and 184*b* and the light signal is sensed by the stack guide sensor 183.

However, although the dark signal is sensed by the stack guide sensor 183, when the light signal is sensed by one sensor among the first stacked banknote sensor 184*a* and the second stacked banknote sensor 184*b*, the controller 190 determines that the banknote stacking space 130 has abnormal banknotes and still has free space in which banknotes may be stacked and controls the push plate driver 145 so that the push plate 140 is kept in the stopped state.

Meanwhile, the controller 190 determines that the banknote stacking space 130 has no free space when the number of banknotes stacked in the banknote stacking space 130 is further increased and the dark signal is sensed by all of the first stacked banknote sensor 184*a*, the second stacked banknote sensor 184*b*, and the stack guide sensor 183, as illustrated in FIG. 12, and the controller 190 controls the push plate driver 145 so that the push plate 140 is moved in a direction of an arrow from a dotted line toward a solid line, as illustrated in FIG. 13.

In this case, the controller 190 may gradationally control the operation of the push plate driver 145 so that push plate 140 is moved until the dark signal changes to the light signal in the stack guide sensor 183.

That is, the operating motor of the push plate driver 145 may include a step motor, and, in the state of FIG. 12, the step motor operates the push plate 140 to move 0.1 steps. The controller 190 controls the push plate driver 145 so that the push plate 140 moves 0.2 steps when the dark signal is sensed by the stack guide sensor 183 even when the push plate 140 moves 0.1 steps. The controller 190 controls the push plate driver 145 so that the push plate 140 moves 0.3 steps, 0.4 steps, and 0.5 steps step-by-step until the dark signal changes to the light signal in the stack guide sensor 183 when the dark signal is sensed by the stack guide sensor 183 even when the push plate 140 moved 0.2 steps.

According to a configuration of the above-described banknote stacking apparatus 100 according to the embodiments, since the operation of the push plate driver 145 is controlled on the basis of the signal sensed by the stack guide sensor 183 and the signal sensed by the stacked banknote sensors 184 or 184*a* and 184*b*, a moving distance of the push plate 140 can be controlled according to a state of the stacked banknotes inside the banknote stacking space 130, and thus the banknotes can be smoothly stacked.

Since banknotes introduced into one side of a banknote stacking space are pressed in a direction toward a push plate by a damper and temporarily stopped, a banknote stacking apparatus according to the present invention can prevent the banknotes from being blown away and improve stacking quality of the banknotes even when various types of banknotes having different lengths are stacked.

Also, since an elastic sheet of a stack roller is formed to laterally hit a banknote while the banknote is temporarily stopped, banknotes can be stably stacked.

Also, since a banknote sensor controls operations of a damper driver and a stack roller on the basis of a time at which a rear end of a banknote sensed by the banknote sensor passes the banknote sensor, banknotes can be stably stacked even when various types of banknotes are stacked.

Also, since a damper sensor senses a location of a damper to control an operation of a damper driver, a location of the damper being rotatably operated can be accurately controlled.

Also, since an operation of a push plate driver is controlled on the basis of signals sensed by a stack guide sensor and stacked banknote sensors, a moving distance of the push plate can be controlled according to a state of stacked banknotes inside a banknote stacking space, and thus the banknotes can be smoothly stacked.

As described above, the present invention is not limited within the above-described embodiment, and it should be apparent to those skilled in the art that various modifications can modify the embodiment of the present invention without departing from the spirit or scope of the invention. Thus, the modifications should be considered as being within the scope of the present invention.

What is claimed is:

1. A banknote stacking apparatus for stacking banknotes in a banknote stacking space, comprising:

a stacker configured to stack banknotes in the banknote stacking space;

a push plate provided to support the banknotes stacked in the banknote stacking space and be movable in a reciprocating direction;

a stack guide configured to guide the banknote which passes the stacker to be loaded into the banknote stacking space;

a damper configured to press the banknote introduced into one side of the banknote stacking space toward the push plate located on the other side of the banknote stacking space and prevent the banknote from being blown away, the damper comprising:

a rotary shaft part rotatably coupled to the stack guide, and a plurality of pressers configured to overlap the stack guide and be rotated in the direction toward the banknote stacking space and the direction away from the banknote stacking space based on a front surface of the stack guide, and provided at a predetermined interval;

a damper driver configured to operate the damper to move in a direction toward the banknote stacking space and a direction away from the banknote stacking space;

a damper sensor configured to sense a location of a protruding piece rotated, wherein the protruding piece is formed to protrude outward from the rotary shaft part of the damper; and a controller configured to control an operation of the damper driver on the basis of a signal sensed in the damper sensor;

wherein the damper is provided to be coupled to an upper portion of the stack guide and is rotatable in the direction toward the banknote stacking space and the direction away from the banknote stacking space based on the front surface of the stack guide, wherein the damper leaves the banknote stacking space and is located inside the stack guide before the banknote enters the banknote stacking space, wherein the damper is rotated toward a front side of the stack guide and presses the banknotes toward the push plate at a time at which the banknote enters the banknote stacking space.

2. The banknote stacking apparatus of claim 1, wherein the stacker includes a stack roller having a plurality of elastic sheets which hit a banknote pressed by the damper and are attached to an outer circumferential surface thereof.

3. The banknote stacking apparatus of claim 2, the stack roller hits a banknote moved by the damper in a lateral direction toward the push plate.

4. A banknote stacking apparatus for stacking banknotes in a banknote stacking space, comprising:

a stacker configured to stack banknotes in the banknote stacking space;

a push plate provided to support the banknotes stacked in the banknote stacking space and be movable in a reciprocating direction;

a stack guide configured to guide the banknote which passes the stacker to be loaded into the banknote stacking space;

a damper configured to press the banknote introduced into one side of the banknote stacking space toward the push plate located on the other side of the banknote stacking space and prevent the banknote from being blown away;

a damper driver configured to operate the damper to move in a direction toward the banknote stacking space and a direction away from the banknote stacking space;

a banknote sensor configured to sense whether the banknote transferred into a banknote stacking space pass by; and a controller configured to control an operation of the damper driver on the basis of a time at which the banknote sensed by the banknote sensor passes the banknote sensor;

wherein the controller controls the operation of the damper driver on the basis of a time at which a rear end of the banknote sensed by the banknote sensor passes the banknote sensor.

5. A banknote stacking apparatus for stacking banknotes in a banknote stacking space, comprising:

a stacker configured to stack banknotes in the banknote stacking space;

a push plate provided to support the banknotes stacked in the banknote stacking space and be movable in a reciprocating direction;

a stack guide configured to guide the banknote which passes the stacker to be loaded into the banknote stacking space;

a damper configured to press the banknote introduced into one side of the banknote stacking space toward the push plate located on the other side of the banknote stacking space and prevent the banknote from being blown away;

a damper driver configured to operate the damper to move in a direction toward the banknote stacking space and a direction away from the banknote stacking space;

a banknote sensor configured to sense whether the banknote transferred into a banknote stacking space pass by; and a controller configured to control an operation of the damper driver on the basis of a time at which the banknote sensed by the banknote sensor passes the banknote sensor;

wherein the controller controls the damper to be rotated toward a front side of the stack guide, press a preceding banknote toward the push plate, and hold the preceding banknote when a predetermined time elapses after a rear end of the preceding banknote is sensed by the banknote sensor, and controls the damper to be rotated in the direction away from the banknote stacking space and release the preceding banknote when the banknote sensor senses a front end of a next banknote.

6. The banknote stacking apparatus of claim 5, wherein the predetermined time has a fixed value and is a time from a time at which the rear end of the preceding banknote is sensed by the banknote sensor to a time at which the rear end of the preceding banknote enters the banknote stacking space.

7. A banknote stacking apparatus for stacking banknotes in a banknote stacking space, comprising:

a stacker configured to stack banknotes in the banknote stacking space;

a push plate provided to support the banknotes stacked in the banknote stacking space and be movable in a reciprocating direction;

a stack guide configured to guide the banknote which passes the stacker to be loaded into the banknote stacking space;

a damper configured to press the banknote introduced into one side of the banknote stacking space toward the push plate located on the other side of the banknote stacking space and prevent the banknote from being blown away; and a damper driver configured to operate the damper to move in a direction toward the banknote stacking space and a direction away from the banknote stacking space;

wherein the damper is provided to be coupled to an upper portion of the stack guide and is rotatable in the direction toward the banknote stacking space and the direction away from the banknote stacking space based on a front surface of the stack guide, wherein the damper leaves the banknote stacking space and is located inside the stack guide before the banknote enters the banknote stacking space; and the damper is rotated toward a front side of the stack guide and presses the banknotes toward the push plate at a time at which the banknote enters the banknote stacking space, wherein the damper includes:

a rotary shaft part rotatably coupled to the stack guide; and a plurality of pressers configured to overlap the stack guide and be rotated in the direction toward the banknote stacking space and the direction away from the banknote stacking space based on the front surface of the stack guide, and provided at a predetermined interval, wherein the damper driver includes:

a motor configured to be bidirectionally and rotatably operated; and a belt configured to transfer power of the motor to the rotary shaft part of the damper.

8. A banknote stacking apparatus for stacking banknotes in a banknote stacking space, comprising:

a stacker configured to stack banknotes in the banknote stacking space;

a push plate provided to support the banknotes stacked in the banknote stacking space and be movable in a reciprocating direction;

a stack guide configured to guide the banknote which passes the stacker to be loaded into the banknote stacking space;

a damper configured to press the banknote introduced into one side of the banknote stacking space toward the push plate located on the other side of the banknote stacking space and prevent the banknote from being blown away; and a damper driver configured to operate the damper to move in a direction toward the banknote stacking space and a direction away from the banknote stacking space;

wherein further comprising:

a stack guide sensor configured to sense a location of the stack guide rotated and provided to be rotatable in a range of a predetermined angle according to an increase of the number of banknotes stacked in the banknote stacking space;

a push plate driver configured to operate the push plate to move in a reciprocating direction; and a controller configured to control an operation of the push plate driver on the basis of a signal sensed by the stack guide sensor.

9. The banknote stacking apparatus of claim 8, further comprising a stacked banknote sensor configured to sense a presence or absence of banknotes stacked in the banknote stacking space, wherein the controller controls the operation of the push plate driver on the basis of a signal sensed by the stacked banknote sensor.

10. The banknote stacking apparatus of claim 9, wherein the stacked banknote sensor includes a first stacked banknote sensor and a second stacked banknote sensor separated at both sides of the banknote stacking space.

11. The banknote stacking apparatus of claim 10, wherein the controller controls the operation of the push plate driver so that the push plate is moved to a set location to expand the banknote stacking space when the stack guide sensor senses that the stack guide is located at a location at which the stack guide is pushed backward and rotated due to the number of banknotes stacked in the banknote stacking space, and the first stacked banknote sensor and the second stacked banknote sensor simultaneously sense the presence of banknotes.

12. The banknote stacking apparatus of claim 11, wherein the controller controls the operation of the push plate driver in a step-by-step manner so that the push plate is moved until the stack guide is not sensed by the stack guide sensor.

13. The banknote stacking apparatus of claim 8, wherein:

a protrusion is formed on one side of the stack guide; and the stack guide sensor senses a location of the protrusion rotated.

14. The banknote stacking apparatus of claim 8, wherein the stack guide is elastically supported to be rotated in the direction toward the banknote stacking space.

* * * * *